US006047850A

United States Patent [19]

Matthews

[11] Patent Number: 6,047,850

[45] Date of Patent: Apr. 11, 2000

[54] PLASTIC EAR COLLAR

[75] Inventor: Glen Matthews, Toronto, Canada

[73] Assignee: Crown Cork & Seal Technologies Corporation, Alsip, Ill.

[21] Appl. No.: 09/123,237

[22] Filed: Jul. 28, 1998

[30] Foreign Application Priority Data

Mar. 6, 1998 [CA] Canada ..... 2231415

[51] Int. Cl.[7] ..... B65D 25/32

[52] U.S. Cl. ..... 220/760; 220/776

[58] Field of Search ..... 220/758, 759, 220/760, 776, 774, 773, 570; 294/31.2, 33

[56] References Cited

U.S. PATENT DOCUMENTS

| | | | |
|---|---|---|---|
| 904,337 | 11/1908 | Lee | 220/758 |
| 2,781,221 | 2/1957 | Pekora | 220/758 |
| 2,849,252 | 8/1958 | Mc Lean | 220/758 |
| 3,015,412 | 1/1962 | Klages | 220/91 |
| 3,331,527 | 7/1967 | Kaas et al. | 220/760 |
| 3,737,069 | 6/1973 | Owen | 220/754 |
| 4,220,254 | 9/1980 | Morton | 220/798 |
| 4,387,922 | 6/1983 | Geisinger | 294/31.2 |
| 5,381,918 | 1/1995 | Dahl | 220/256 |

FOREIGN PATENT DOCUMENTS

| | | |
|---|---|---|
| 0 423 656 | 4/1991 | European Pat. Off. . |
| 2700155A | 7/1994 | France . |
| 85 23 336 U | 10/1985 | Germany . |

*Primary Examiner*—Stephen Castellano
*Attorney, Agent, or Firm*—Woodcock Washburn Kurtz Mackiewicz & Norris LLP

[57] ABSTRACT

A plastic ear collar (10) for a can (30) which has a top circumferential channel (33) defining an outer projecting ledge (34) is disclosed. The collar (10) comprises a circumferential ring (11) having a diameter which is selected to pressingly engage a side wall (31) of a can (30) about the outer projecting ledge (34) thereof. A pair of bail holes (9) are integrally formed with the ring (11), each of the bail holes (9) being diametrically disposed on a respective side of the ring (11).

23 Claims, 2 Drawing Sheets

PLASTIC EAR COLLAR

TECHNICAL FIELD

The present invention relates to an ear collar, and particularly, but not exclusively fabricated of plastics and defined by a circumferential ring which is flexible and provides with bail holes. The ring is pressingly engaged about a side wall of a can below the circumferential top seam thereof.

BACKGROUND ART

Conventional metal cans which are provided with a bail to carry same, such as for example one gallon paint cans, are provided with ears which are welded, clinched or otherwise attached, on diametrically opposed sides of the side wall of the can whereby to attach the bail. In the fabrication of the can the application of the ear to the paint can causes problems in the assembly process. For example, when metal ears are welded to the side wall of the can the welding process can cause some destruction and cause bare metal to be exposed on the inside of the can. When latex paint is placed in such cans, consumers can find rust floating on top of their paint due to its contact with bare metal. The precise ear placement is also problematic with welded ears, often leading to rejecting products and requiring extra inspection.

A further problem with paint cans on which ears are welded is that when labels are applied to the can the machine must take into consideration the location of the ears and this poses a restriction on the speed of operation. It also causes defective label applications and again resulting in rejection of cans where labels are improperly applied and therefore requiring more labor to recycle such cans. The current method of applying labels to the paint can is literally a slow rolling process. Before the label is applied, the can has to be indexed so that the ears are properly timed as they pass through the labeling process, a definite bottleneck. Once indexed, the can is rolled over glue and then over a paper label.

SUMMARY OF INVENTION

It is therefore a feature of the present invention to provide an ear collar which is clampingly secured to the can and which substantially overcomes the above-mentioned disadvantages of the prior art.

Another feature of the present invention is to provide a plastic ear collar which is clampingly fitted about the circumferential side wall of a can about the double seam circumferential top edge and which is provided with a pair of bail holes diametrically disposed on the ring whereby to attach a bail thereto.

Another feature of the present invention is to provide a can equipped with a circumferential ear collar of flexible material and which is clampingly retained about the side wall of the can about the double circumferential seam of the can.

Another feature of the present invention is to provide a can having a circumferential ear collar clampingly retained about the double circumferential seam of the can and wherein the side wall of the can contains lithographic printing about.

According to the above features, from a broad aspect, the present invention provides an ear collar for a can having a top circumferential seam. The collar comprises a circumferential ring of flexible material and having a diameter selected to engage a side wall of a can about the circumferential seam. A pair of bail holes are integrally formed with the ring and each bail hole is diametrically disposed on a respective side of the ring.

In a preferred embodiment, the ear collar is formed of plastics material.

According to a further broad aspect of the present invention, there is provided a can comprising a circumferential side wall, a bottom wall and a top open end. A circumferential channel is provided about the top open end to removably attach therein a cover. A circumferential ear collar, of flexible material, is retained about the side wall under an outer projecting ledge of the channel. A pair of bail holes are integrally formed with the collar. The bail holes are diametrically disposed on a respective side of the ring to attach thereto a bail to transport the can.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
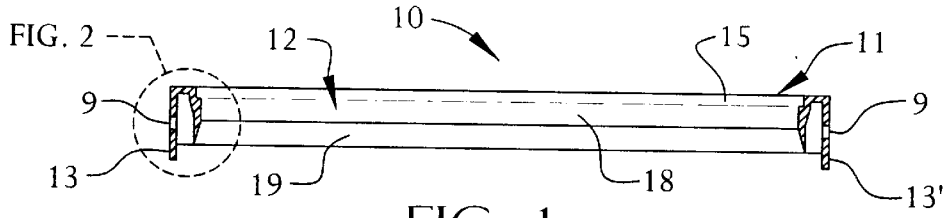
FIG. 1 is a transverse cross-section view of the ear collar of the present invention.
Figure 2:
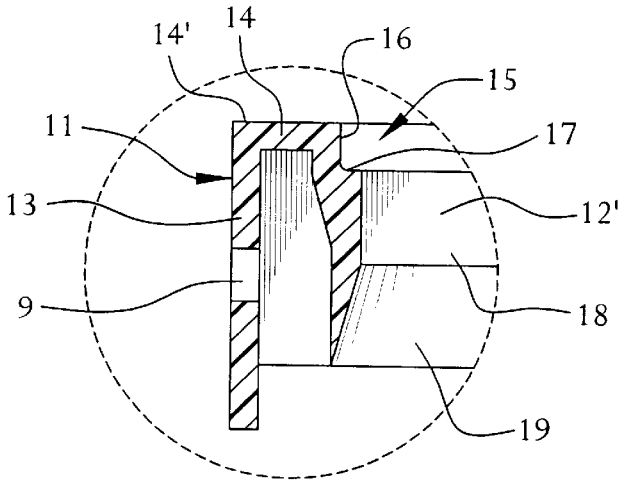
FIG. 2 is an enlarged cross-section view of the section end view of the ear collar shown in FIG. 1.
Figure 3:
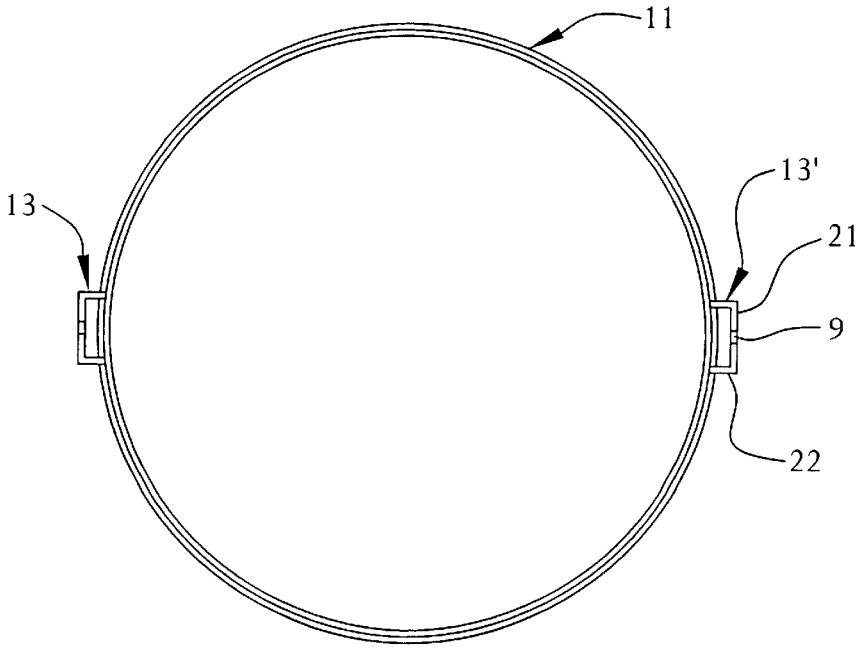
FIG. 3 is a top view of the ear collar.

Referring now to the drawings and more particularly to FIGS. 1 to 4, there is shown generally at 10 the ear collar of the present invention. The ear collar is formed as a circumferential circular ring 11, as shown in FIG. 3, and having a diameter which is selected to clampingly engage a side wall of a can, as will be described later, about a top circumferential seam thereof. As shown in FIG. 2, the circumferential ring 11 is integrally formed and defines a flexible wall 12 which is provided with a pair of spaced downwardly projecting flange structures 13 and 13' outwardly spaced from the flexible wall 12 and interconnected thereto by an intermediate top wall 14. Each of the downwardly projecting flange structures 13 and 13' are provided with a bail hole 9 therein whereby to attach thereto a bail to transport a can, as will be described later.

Referring again to FIG. 2, it can be seen that the flexible wall 12 has a circumferential recess 15 formed in an inner side surface thereof about a top end of the flexible wall whereby to clampingly receive therein a circumferential edge of a double seam of a can. The circumferential recess 15 is a rectangular recess having a flat vertical wall 16 extending to the top surface 14' of the intermediate top wall 14, and a flat transverse bottom wall 17 extending to the inner surface 12' of the ring. The vertical wall 16 may also be shaped to mirror the contour of the outer edge of the seam 34 (see FIG. 7). The ring 11 is also provided with a flat vertical surface 18 on the inner face 12' and disposed intermediate the circumferential recess and a tapered lower section 19. This surface area 18 prevents deformation of the recess 15. The inner surface 12', in the tapered lower section 19, tapers outwardly whereby to cause the flexible wall 12 to flex outwardly when the circumferential ring 11 is press fitted over a circumferential top seam of a can.

Figure 4:
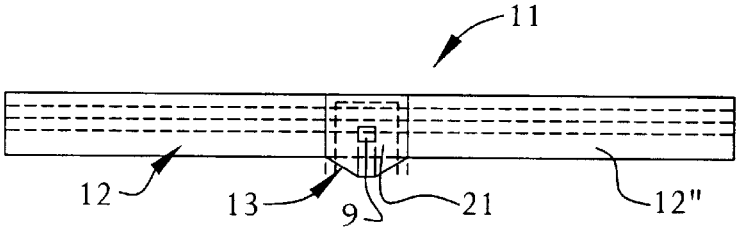
FIG. 4 is a side view of the ear collar showing the position and construction of the flanges in which the bail holes are provided.
Figure 5:
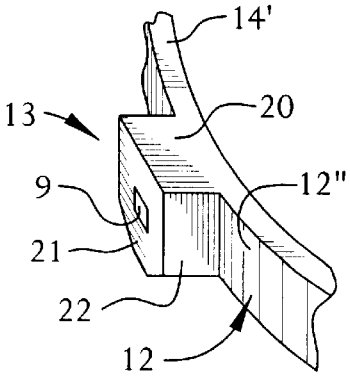
FIG. 5 is a fragmented perspective view showing the construction of the flange structure in which the bail hole is provided.

With specific reference now to FIGS. 3 to 5, there will be described the construction of the downwardly projecting flange structures 13 and 13' . As is more clear from FIG. 5, and as previously described, the flange structure 13 is integrally formed with the ring and diametrically disposed on a respective side thereof. The flange structure comprises a top rectangular wall 20 which extends from the top flat wall 14' of the ring 11 and merges into an integrally formed depending outer transverse flange wall 21. Opposed integrally formed side walls 22 interconnect the flange wall 21 to the outer side surface 12" of the flexible wall 12 to retain the flange wall substantially parallel to the flexible wall and to provide for a structural flange structure.

Although the ear collar as herein shown is molded of plastics material, it is also conceivable that it could be stamped from metal having the required flexibility to provide its attachment to cans.

Figure 6:
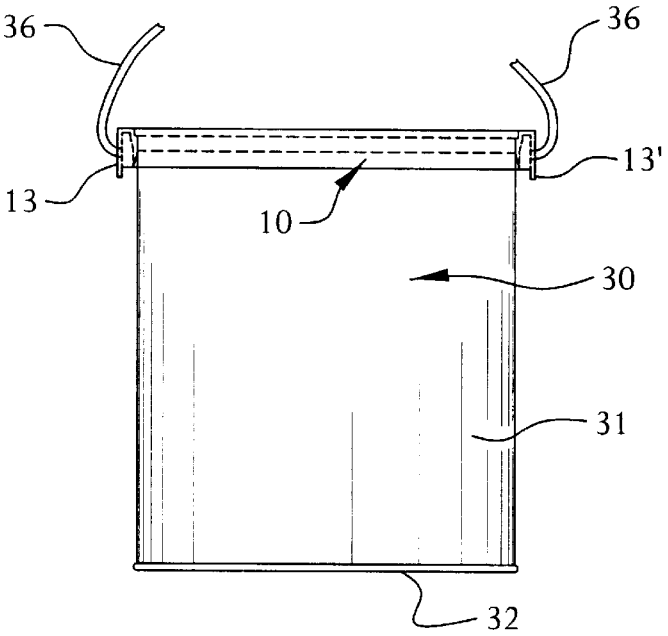
FIG. 6 is a side view showing an ear collar secured to a one gallon paint can.
Figure 7:
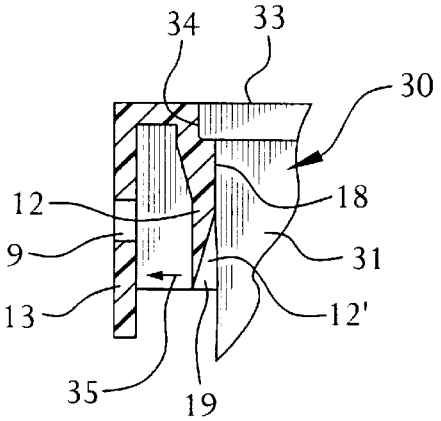
FIG. 7 is a fragmented section view showing the position of the ear collar about the side wall of the can under the outer projecting ledge of the double circumferential seam thereof.

Referring now to FIGS. 6 and 7, there is shown a one gallon paint can 30 which is comprised of a circumferential side wall 31, a bottom wall 32 and a top circumferential channel 33 being formed about a top open end of the can to removably attach a cover (not shown) thereto, as is obvious to a person skilled in the art. The seam connecting the circumferential channel to the side wall defines an outer projecting ledge 34 spaced outwardly of the side wall 31 of the can as shown in FIG. 7.

As can be seen from these Figures, the circumferential ear collar 10 is press fitted about the circumferential channel 33 of the can from the top end thereof whereby the inner surface 12' in the tapered lower section 19 of the flexible wall 12 will flex outwardly in the direction of arrow 35, as shown in FIG. 7, to permit the ring to stretch and snap-fit about the outer projecting ledge 34 with the flat vertical wall 18 retained about a top circumferential side wall portion of the can 30. With the plastic ear collar 10 thus engaged, it is now possible to attach a bail, such as the bail 36 shown in FIG. 6, to the ear structures 13 and 13' of the collar whereby to transport the can. The lower edge of the outer projecting ledge 34 sits over the flat circumferential wall 17 whereby when the can is carried by the bail 36, the weight of the can is supported on the circumferential wall 17 of the ring 11.

By providing plastic ear collars about the top ends of the cans, as shown in FIG. 6, a significant improvement results in the manufacturing process. Previously, during assembly, when using a welding process to attach the ear, it was necessary to apply a lacquer coating inside the can. This is now eliminated as there is no longer a need to do so since the ears are no longer welded and this eliminates the problem of exposing metal inside the can which forms rust. It is also no longer necessary to have a process oven to cure the lacquer. Since the ear welding process is eliminated from the assembly, the problem with precise ear placement is also eliminated resulting in faster assembly. The need to inspect welded ears is no longer required. Further, more aesthetically pleasing paint cans can be produced with the ear collar of the present invention.

It is within the ambit of the present invention to cover any obvious modifications thereof, provided such modifications fall within the scope of the appended claims. Also, it is to be understood that the phraseology and terminology employed herein are for the purpose of description and should not be regarded as limiting. Those skilled in the art will appreciate that the conception upon which this disclosure is based may readily be utilized as a basis for the redesigning of other structures for carrying out the several purposes of the present invention. It is important, therefore, that the claims be regarded as including such equivalent constructions insofar as they do not depart from the spirit and scope of the present invention.

I claim:

1. A can comprising (i) a circumferential side wall, (ii) a bottom wall, (iii) a top open end, (iv) a circumferential channel about said top open end to removably attach thereto a cover, (v) a circumferential ear collar comprising a circumferential ring of flexible plastics material retained about said side wall under an outer projecting ledge of said circumferential channel, and (vi) a pair of bail holes integrally formed with said ring, said bail holes being diametrically disposed on a respective side of said ring to attach thereto a bail to transport said can, wherein said circumferential ring is formed as a flexible wall having an inner side surface and an outer side surface, a circumferential recess being formed in said inner side surface about a top end of said flexible wall to receive therein said outer projecting ledge of said circumferential channel.

2. A can as claimed in claim 1 wherein uninterrupted printed material is disposed on said circumferential side wall of said can between said collar and a lower edge of said can.

3. A can as claimed in claim 1 wherein said flexible wall has a tapered lower section, said inner side surface having an outward taper to cause said flexible wall to flex outwardly when said ring is press fitted over said outer projecting ledge of said circumferential channel of a can.

4. A can as claimed in claim 3 wherein said ring is provided with a flat vertical surface on said inner face intermediate said circumferential recess and said tapered lower section.

5. A can as claimed in claim 1 wherein said circumferential recess is a rectangular recess having a vertical wall extending to a top wall of said ring, and a flat transverse bottom wall extending to said inner surface of said ring.

6. A can as claimed in claim 1 wherein a pair of spaced, downwardly projecting flange structures are integrally formed with said ring and spaced outwardly of said flexible wall and diametrically disposed on a respective side of said ring, said bail holes being formed in a respective one of said flange structures.

7. A can as claimed in claim 6 wherein said flange structures are structural flange structures, each said flange structure having a top rectangular wall extending from a top flat wall of said ring, and an integrally formed depending outer transverse flange wall, and opposed side walls interconnecting said flange wall to said outer side surface of said ring to retain said flange wall substantially parallel to said flexible wall.

8. A can comprising:

a can body including a circumferential side wall, a bottom wall, and a top open end having an outer projecting ledge;

a circumferential ring of flexible material retained about said side wall of said can body under said outer projecting ledge, said circumferential ring comprising a flexible wall having (i) an inner side surface, (ii) an outer side surface, (iii) a top end, and (iv) a circumferential recess being formed in said inner side surface adjacent said top end of said circumferential ring, said circumferential recess engaging said outer projecting ledge of said can body so as to secure said circumferential ring to said can body; and a bail attached to said ring for transporting said can.

9. A can as claimed in claim 8, wherein said circumferential ring is formed of plastics material.

10. A can as claimed in claim 8, wherein a lower portion of said inner side surface is angled in relation to said outer side surface so as to cause said flexible wall to flex outwardly when said circumferential ring is press fitted over said outwardly projecting ledge of said can body.

11. A can as claimed in claim 10, wherein said inner side surface forms a vertical wall intermediate said circumferential recess and said lower portion of said inner side surface.

12. A can as claimed in claim 8, wherein said circumferential recess has a substantially rectangular cross section defined by (i) a flat vertical wall extending to said top end of said circumferential ring, and (ii) a flat transverse bottom wall extending to said inner surface of said circumferential ring.

13. A can as claimed in claim 8, wherein said circumferential ring further comprises a pair of spaced, downwardly projecting flange structures, said flange structures being (i) integrally formed with said circumferential ring, (ii) spaced outwardly of said flexible wall, and (iii) diametrically disposed on said circumferential ring, said bail being attached to said flange structures.

14. A can as claimed in claim 28, wherein said flange structures are structural flange structures, each said flange structure having (i) a top rectangular wall extending from said top end of said circumferential ring, (ii) an outer transverse flange wall integrally formed with and depending from said top rectangular wall, and (iii) opposed side walls interconnecting said outer transverse flange wall to said outer side surface of said circumferential ring to retain said outer transverse flange wall substantially parallel to said outer side surface.

15. An ear collar for a can having a side wall and a ledge projecting outwardly from a top end of said can, comprising:

a circumferential ring of flexible material, said circumferential ring having a diameter selected to engage said can side wall about said outwardly projecting ledge, said circumferential ring comprising a flexible wall having (i) an inner side surface, (ii) an outer side surface, (iii) a top end, and (iv) a circumferential recess formed in said inner side surface adjacent said top end of said circumferential ring to receive therein said outwardly projecting ledge of said can, wherein a lower portion of said inner side surface is angled in relation to said outer side surface so as to cause said flexible wall to flex outwardly when said circumferential ring is press fitted over said outwardly projecting ledge of said can; and a pair of bail holes integrally formed with said circumferential ring.

16. An ear collar as claimed in claim 15, wherein said inner side surface forms a vertical wall intermediate said circumferential recess and said lower portion of said inner side surface.

17. An ear collar as claimed in claim 15, wherein said flexible material is a plastics material.

18. An ear collar as claimed in claim 15, wherein said circumferential recess has a substantially rectangular cross section defined by (i) a flat vertical wall extending to said top end of said circumferential ring and (ii) a flat transverse bottom wall extending to said inner surface of said circumferential ring.

19. An ear collar as claimed in claim 15, further comprising a pair of spaced, downwardly projecting flange structures, said flange structures being (i) integrally formed with said circumferential ring, (ii) spaced outwardly of said flexible wall, and (iii) diametrically disposed on said circumferential ring, said bail holes being formed in each of said flange structures.

20. An ear collar for a can having a top circumferential channel, comprising:

a circumferential ring of flexible plastics material, the circumferential ring having a diameter selected to engage a side wall of said can about an outer projecting ledge of said circumferential channel, said circumferential ring being formed as a flexible wall having (i) an inner side surface, (ii) an outer side surface, and (iii) a circumferential recess being formed in said inner side surface about a top end of said flexible wall to receive therein, in close fit, said outer projecting ledge of said circumferential channel;

a pair of bail holes integrally formed with said ring, each said bail hole being diametrically disposed on a respective side of said ring, and a pair of spaced, downwardly projecting flange structures (i) integrally formed with said ring, (ii) spaced outwardly of said flexible wall, and (iii) diametrically disposed on a respective side of said ring, said bail holes being formed in a respective one of said flange structures, wherein said flange structures are structural flange structures, each said flange structure having (i) a top rectangular wall extending from a top flat wall of said ring, (ii) an integrally formed depending outer transverse flange wall, and (iii) opposed side walls interconnecting said flange wall to said outer side surface of said ring to retain said flange wall substantially parallel and spaced from said flexible wall.

21. An ear collar as claimed in claim 20 wherein said flexible wall has a tapered lower section, said inner side surface having an outward taper to cause said flexible wall to flex outwardly when said ring is press fitted over an outer projecting ledge of a circumferential channel of a can.

22. An ear collar as claimed in claim 21 wherein said ring is provided with a vertical surface on said inner side surface intermediate said circumferential recess and said tapered lower section.

23. An ear collar as claimed in claim 20 wherein said circumferential recess is a rectangular recess having a flat vertical wall extending to a top wall of said ring, and a flat transverse bottom wall extending to said inner surface of said ring.

* * * * *

UNITED STATES PATENT AND TRADEMARK OFFICE

CERTIFICATE OF CORRECTION

PATENT NO. : 6,047,850
DATED : April 11, 2000
INVENTOR(S) : Matthews

It is certified that error appears in the above-identified patent and that said Letters Patent is hereby corrected as shown below:

Column 5, claim 14,
Line 1, please delete "in claim 28" and insert therefor -- in claim 13 --.

Signed and Sealed this

Twenty-second Day of January, 2002

*Attest:*

*Attesting Officer*

JAMES E. ROGAN
*Director of the United States Patent and Trademark Office*